US006291946B1

(12) United States Patent
Hinman

(10) Patent No.: US 6,291,946 B1
(45) Date of Patent: Sep. 18, 2001

(54) SYSTEM FOR SUBSTANTIALLY ELIMINATING TRANSIENTS UPON RESUMPTION OF FEEDBACK LOOP STEADY STATE OPERATION AFTER FEEDBACK LOOP INTERRUPTION

(75) Inventor: Roderick T. Hinman, Natick, MA (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/628,516

(22) Filed: Jul. 31, 2000

(51) Int. Cl.[7] ..... H05B 37/02

(52) U.S. Cl. ..... 315/307; 315/224; 315/DIG. 4; 315/DIG. 5

(58) Field of Search ..... 315/307, DIG. 4, 315/308, DIG. 5, 224

(56) References Cited

U.S. PATENT DOCUMENTS

| | | | | |
|---|---|---|---|---|
| 5,680,017 | | 10/1997 | Veldman et al. | 315/308 |
| 5,719,474 | | 2/1998 | Vitello | 315/307 |
| 5,742,134 | | 4/1998 | Wacyk et al. | 315/307 |
| 5,973,458 | * | 10/1999 | Seo et al. | 315/308 |
| 6,011,360 | | 1/2000 | Gradzki et al. | 315/244 |

* cited by examiner

*Primary Examiner*—David Vu

(57) ABSTRACT

A system for enabling an apparatus having a feedback loop to resume steady state operation after feedback loop interruption without the occurrence of transients, the system generally comprising a first circuit for applying a state variable to a load and a second circuit for (i) controlling the first circuit, (ii) monitoring the state variable applied to the load, and (iii) controlling the first circuit to regulate the state variable applied to the load in accordance with a desired state variable. The first and second circuits and the load define a feedback loop. The second circuit further includes an input for receiving a control signal that has a first state that causes the second circuit to enable the first circuit to apply the state variable to the load and a second state that causes the second circuit to inhibit the first circuit from applying the state variable to the load thereby interrupting the feedback loop. The system further comprises a third circuit for storing the applied state variable and preventing decay of the stored state variable during interruption of the feedback loop. The feedback loop resumes operation and returns to a steady state operation in accordance with the stored state variable when the control signal returns to the first state thereby substantially preventing the occurrence of transients from being introduced into the system.

10 Claims, 2 Drawing Sheets

SYSTEM FOR SUBSTANTIALLY ELIMINATING TRANSIENTS UPON RESUMPTION OF FEEDBACK LOOP STEADY STATE OPERATION AFTER FEEDBACK LOOP INTERRUPTION

BACKGROUND OF THE INVENTION

1. Field of the Invention

The present invention generally relates to a circuit for interrupted feedback loop operation.

2. Problem to be Solved

Feedback loops are commonly used in electronic or electromechanical systems to regulate some parameter of interest. For example, a feedback loop can be used to regulate lamp current or power in a ballast for a fluorescent lamp. In many instances, it is necessary to interrupt the operation of a feedback loop. For example, the feedback loop used to regulate the lamp current or power in the ballast is interrupted in order to dim the lamp by modulating the time that the lamp is on and off. Pulse-width-modulation ("PWM") is typically used to achieve such modulation. Thus, when the lamp is on, the feedback loop is regulating lamp current or power in the ballast, but when the lamp is off, the feedback loop operation is interrupted.

One problem resulting from interruption of feedback loop operation is that the state variables in the feedback loop often decay during the interruption time and deviate from their steady state operating points. This decay is typically due to the RC (resistor capacitor) networks that normally function as filters in the feedback loop. When loop operation resumes, there is a transient associated with returning to steady state operation. This transient is generally worsened by the deviated state variables. For example, in one particular commercially available lighting system with dimming capability, the state variable is the lamp power and the decay occurs during PWM dimming. As a result of the decay, the switching frequency is initially relatively low because the feedback loop operates as though the lamp power is too low. This low switching frequency can saturate the resonant inductor thereby leading to excessive currents in the circuit and increased likelihood of visible flicker in the display.

One attempt at solving this problem is to clamp the state variable, during circuit interruption, to a value near its operating value. When operation resumes, the state variables are nearly correct and the transient is reduced in amplitude and/or duration. However, variations in circuit component values and variations in operating conditions can lead to different, and non-ideal, clamping values. As the operating conditions (such as input voltage) vary, the operating point of the state variable changes. Therefore, the fixed clamp value is only perfect for a single operating point and less than ideal for all other conditions.

It is therefore an object of the present invention to provide a feedback loop interruption circuit that solves the problem inherent in the prior art circuit discussed above.

Other objects and advantages of the present invention will be apparent to one of ordinary skill in the art in light of the ensuing description of the present invention.

SUMMARY OF THE INVENTION

In one aspect, the present invention is directed to a system for substantially eliminating transients upon the resumption of feedback loop steady state operation after feedback loop interruption. The system generally comprises a first circuit for applying a state variable to a load, a second circuit for (i) controlling the first circuit, (ii) monitoring the state variable applied to the load, and (iii) controlling the first circuit to regulate the state variable applied to the load in accordance with a desired state variable, and a third circuit for storing the applied state variable. The first and second circuits and the load define a feedback loop. The second circuit further includes an input for receiving a control signal that has a first state that causes the second circuit to enable the first circuit to apply the state variable to the load, and a second state that causes the second circuit to inhibit the first circuit from applying the state variable to the load thereby interrupting the feedback loop. The third circuit stores the applied state variable and prevents decay of the stored state variable during interruption of the feedback loop. The feedback loop resumes operation and returns to a steady state operation in accordance with the stored state variable when the control signal returns to the first state thereby substantially preventing the occurrence of transients from being introduced into the system.

In a related aspect, the present invention is directed to a system for substantially eliminating transients upon the resumption of feedback loop steady state operation after feedback loop interruption wherein the system generally comprises a first circuit for applying power to a load, a second circuit for (i) controlling the first circuit, (ii) monitoring the power applied to the load, and (iii) controlling the first circuit to regulate the power to the load in accordance with a predetermined amount of power, and a third circuit for storing a signal representative of the power applied to the load. The first and second circuits and the load define a feedback loop. The second circuit further includes an input for receiving a control signal that has a first state that causes the second circuit to enable the first circuit to apply the power to the load, and a second state that causes the second circuit to inhibit the first circuit from applying the power to the load thereby interrupting the feedback loop. The third circuit, which stores a signal representative of the power applied to the load, prevents decay of the stored signal during feedback loop interruption. The feedback loop resumes operation and returns to a steady state operation in accordance with the stored signal when the control signal returns to the first state thereby substantially preventing the occurrence of transients from being introduced into the system.

In yet another aspect, the present invention is directed to a ballast for powering a load having a lamp, comprising a power circuit for applying power to a lamp, a control circuit for (i) controlling the power circuit, (ii) monitoring the power applied to the lamp, and (iii) controlling the power circuit to regulate the power to the lamp in accordance with a predetermined amount of power, and a storage circuit for storing a signal representative of the power applied to the load. The control and power circuits and the lamp define a feedback loop. The control circuit further includes an input for receiving a control signal that has a first state that causes the control circuit to enable the power circuit to apply the power to the lamp, and a second state that causes the control circuit to inhibit the power circuit from applying the power to the lamp thereby interrupting the feedback loop. The ballast further comprises a dimming circuit for dimming the lamp. The dimming circuit comprises circuitry for generating the control signal wherein the first state of the control signal effects illumination of the lamp and the second state interrupts the feedback loop and prevents illumination of the lamp. The storage circuit, which stores a signal representative of the power applied to the load, prevents decay of the stored signal during feedback loop interruption so as to enable the feedback loop to resume operation and return to a steady state operation in accordance with the stored signal when the control signal returns to the first state. In one embodiment, the storage circuit comprises a control device and a storage device. The control device is responsive to the control signal such that when the control signal has the second state and the feedback loop is interrupted, the control device prevents decay of the signal stored in the storage device.

In another aspect, the present invention is directed to a method of operating a ballast for powering a lamp, comprising the steps of applying power to the lamp, storing a signal representative of the power applied to the lamp, monitoring the power applied to the lamp, regulating the power applied to the lamp in accordance with a predetermined power, the applying, monitoring and regulating steps defining a feedback loop operation of the ballast, interrupting the applying, monitoring and regulating steps so as to effect dimming of the lamp, and resuming the applying, monitoring and regulating steps so as to return to the feedback loop operation to steady state operation in accordance with the stored signal.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

DETAILED DESCRIPTION OF THE INVENTION

Figure 1:
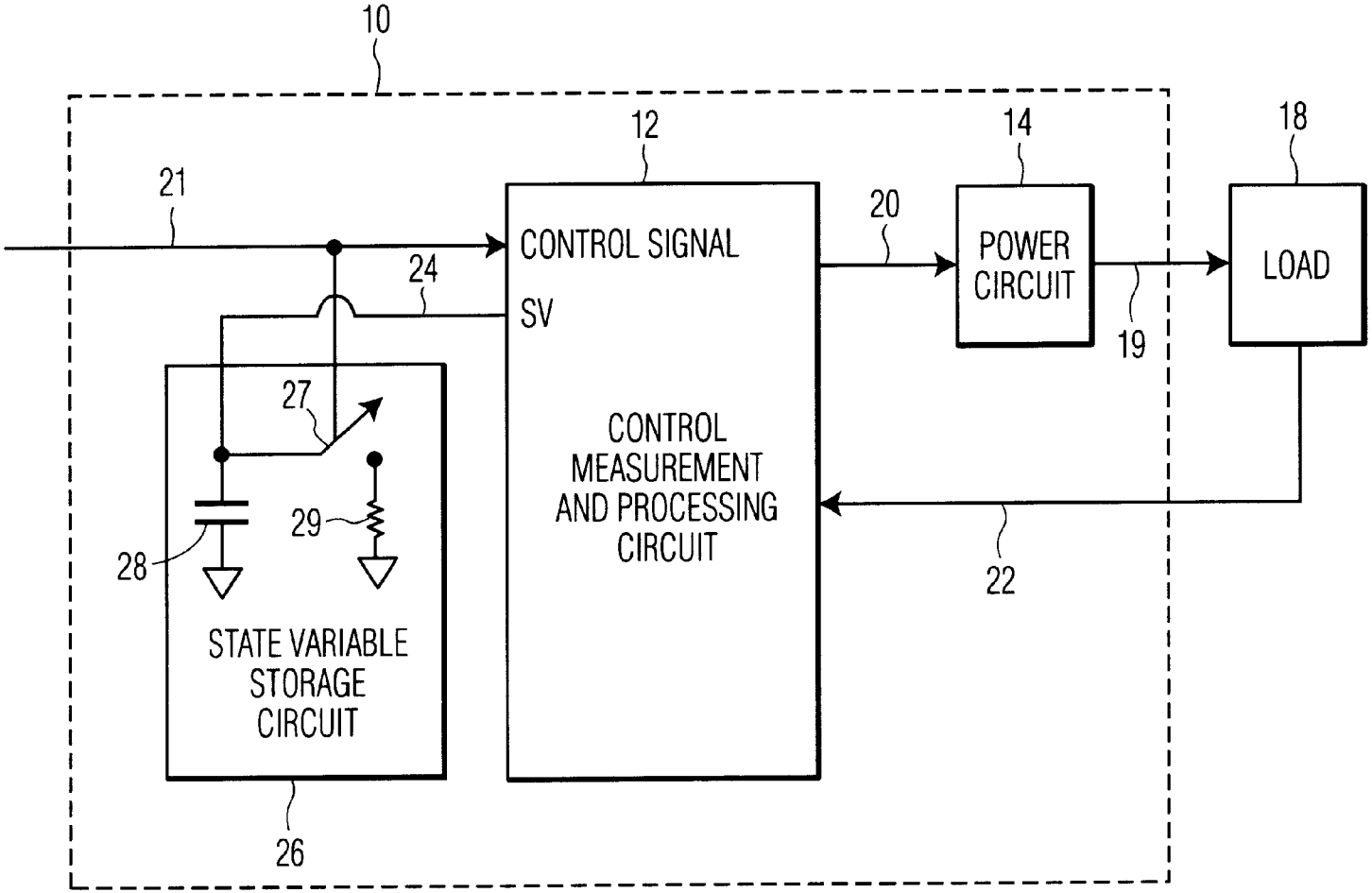
FIG. 1 is block diagram of the system of the present invention.

Referring to FIG. 1, there is shown a block diagram of system 10 of the present invention which addresses and solves the deficiency of the prior art. System 10 generally includes control, measurement and processing circuit 12, power circuit 14 and state variable storage circuit 16. These circuits cooperate to regulate the amount of power applied to load 18. Load 18 can take the form of almost any electronic, electrical or electromechanical apparatus.

Power circuit 14 applies power signal 19 to load 18 upon receipt of signal 20 from control circuit 12. Control circuit 12 includes an input for receiving control signal 21. In one embodiment, control signal 21 is a voltage wave form. Control signal 21 has a first state and a second state. In the first state, control signal 21 has a relatively high amplitude (e.g. between 3.0 volts and 5.0 volts). In the second state, control signal 21 has a relatively low amplitude (e.g. between 0.0 volts and 1.0 volt). In one embodiment, control signal 21 has a 50% duty cycle. When control signal 21 has the first state, control circuit 12 outputs signal 20 that enables power circuit 14 to deliver power to load 18. When control signal 21 has the second state, control circuit 12 does not output signal 20 thereby inhibiting power circuit 14 from delivering power signal 19 to load 18.

Referring to FIG. 1, control circuit 12 further comprises measurement and processing circuitry that effects measurement of parameters of interest such as lamp current and lamp voltage signals 22 and processes these signals in order to generate an error correction signal for use in regulating the power applied to load 18. Control circuit 12 outputs signal 24 which is the instantaneous load power (e.g. instantaneous lamp power). Control circuit 12, power circuit 14 and load 18 define a feedback loop wherein the power applied to load 18 is monitored and regulated accordingly.

Referring to FIG. 1, circuit 10 further comprises state variable storage circuit 26 which generally comprises switch 27, capacitor 28 and resistor 29. Capacitor 28 is connected between the state variable SV pin of control circuit 12 and ground potential. Switch 27 is controlled by control signal 21. When control signal 21 has the first state, switch 27 is closed, signal 24 charges capacitor 28, and an RC (resistor-capacitor) network is formed by capacitor 28 and resistor 29. Capacitor 28 and resistor 29 effect averaging of the instantaneous load power. The time constant of this RC network is 1/RC. Thus, the state variable SV pin of control circuit 12 is presented with the instantaneous load power. When control signal 21 has the second state, switch 27 is open thereby isolating capacitor 28 from resistor 29 and preventing decay of the state variable stored by capacitor 28.

During a first mode of operation of system 10, control signal 21 has a high level thereby controlling control circuit 12 to enable power circuit 14 to deliver power to load 18. During this mode of operation, the feedback loop created by control circuit 12, power circuit 14 and load 18 operates in normal fashion wherein the power applied to the load 18 is continuously monitored and regulated. In a second mode of operation, the operation of the feedback loop is interrupted. Specifically, control signal 21 has a low level thereby causing control circuit 12 to inhibit power circuit 14 from applying power to load 18. Additionally, the low level of control signal 21 opens switch thereby isolating the capacitor 28 from resistor 29 and preventing decay (or discharge) of the state variable (e.g. voltage) stored by capacitor 28 for the duration of the interruption. Thus, when control signal 21 shifts back to the first state (i.e. the first mode of operation) in order to return system 10 to steady state operation, the instantaneous load power just prior to the interruption is still available at the state variable SV pin of control circuit 12. Thus, the feedback loop returns to steady state operation using substantially the same instantaneous load power that was present just prior to the interruption. As a result, transient oscillations, overshoots and pulses are substantially eliminated as feedback loop operation resumes.

System 10 has many applications. One such application is in the operation of fluorescent lamp ballasts of the type disclosed in commonly owned U.S. Pat. Nos. 5,680,017, 5,742,134 and 6,011,360, the disclosures of which are incorporated herein by reference. These types of fluorescent lamp ballast provide lamp dimming capability. However, in order to dim the lamps, interruption of the feedback loops in the fluorescent lamp ballast is necessary. System 10 can be used to substantially eliminate transient oscillations, overshoots and pulses when the dimming function is complete and the ballast returns to steady state operation.

Figure 2:
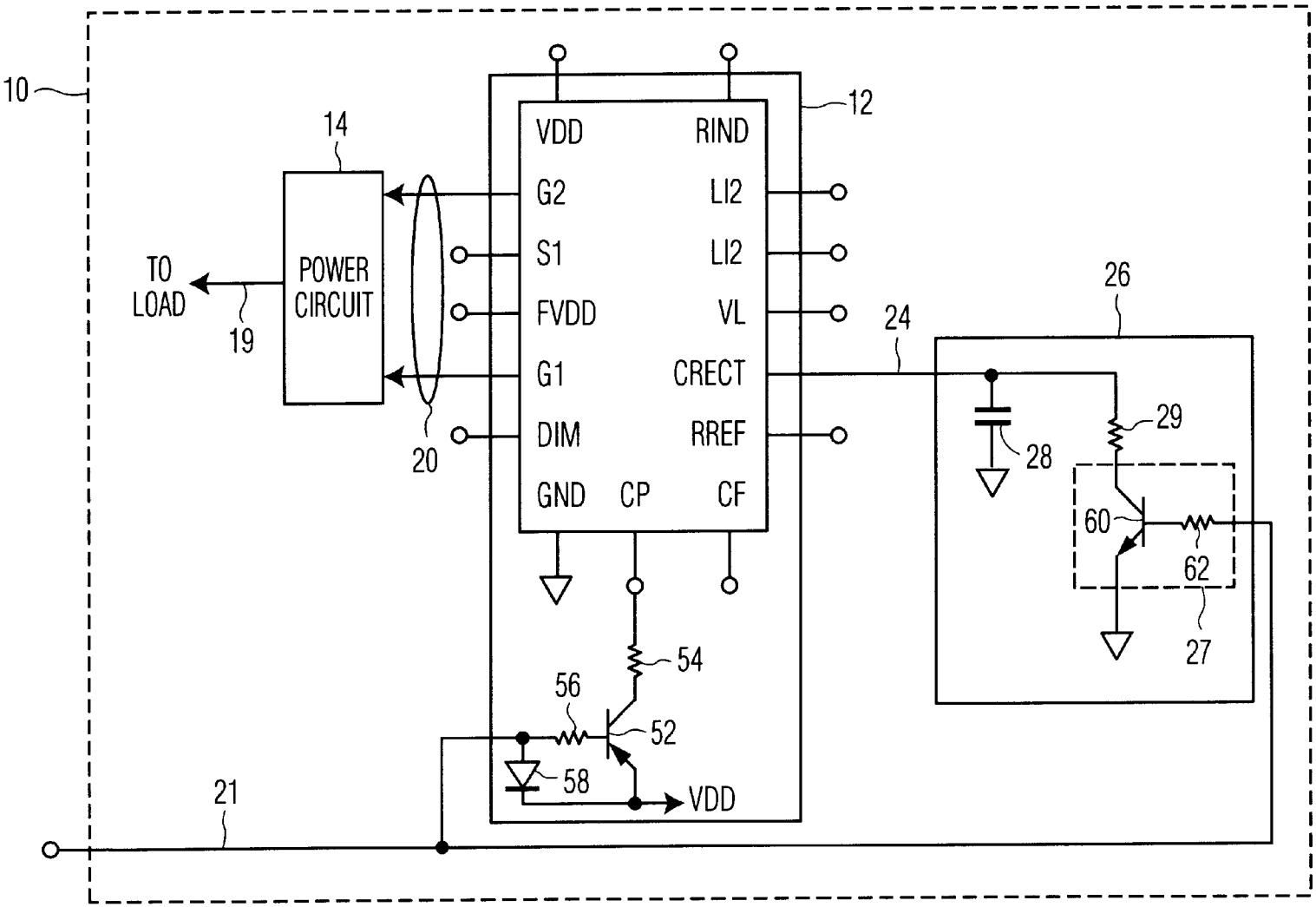
FIG. 2 is a schematic diagram of one embodiment of the system of FIG. 1.

Referring to FIG. 2, there is shown a circuit diagram of one embodiment of system 10 that is configured for use with fluorescent lamp ballasts. In order to facilitate understanding of the present invention, load 18 is described in the ensuing description as a fluorescent lamp. Control, measurement and processing circuit 12 generally comprises an integrated circuit 50 which is configured as integrated circuit 109 described in the aforementioned U.S. Pat. No. 5,680,017 which has been incorporated herein by reference. In order to facilitate understanding of the present invention, and for purposes of brevity, the function of the VDD, RIND, L12, VL, CRECT, RREF, CF, CP, GND, DIM, G1, G2, and FVDD pins of integrated circuit 50 have the same function as the corresponding pins of integrated circuit 109 described in the aforementioned U.S. Pat. No. 5,680,017. Additionally, each pin of integrated circuit 50, with the exception of the CRECT pin, is electrically connected to the same circuit configurations to which the corresponding pins of integrated circuit 109 are connected as shown in U.S. Pat. No. 5,680,017. Circuit 12 farther includes additional circuitry that enables integrated circuit 50 to oscillate when control signal 21 has the first state and to cease oscillating when control signal 21 has the second state. Such operating characteristics are described in the aforementioned U.S. patents that have been incorporated herein by reference. This additional circuitry comprises PNP transistor 52, transistor collector resistor 54, transistor base drive resistor 56 and diode 58. The emitter of transistor 52 is connected to the integrated circuit power supply VDD.

Referring to FIG. 2, in one embodiment, power circuit 14 comprises a pair MOSFETS that are configured in half-bridge topology and associated circuitry as shown in U.S. Pat. No. 5,680,017. State variable storage circuit 26 comprises capacitor 28, resistor 29 and switch 27, all of which being mentioned in the foregoing description. Switch 27 comprises NPN transistor 60 and transistor base drive resistor 62. In the first mode of operation (i.e. when control signal 21 has a high level), transistor 60 conducts thereby creating a current path to ground through resistor 29. As a result, integrated circuit 50 oscillates as described in U.S. Pat. No. 5,680,017. The current flowing out the CRECT pin into ground reflects the average power of the lamp 18. In order to dim lamp 18, system 10 must be shifted into the second mode of operation. Thus, the level of control signal 21 is shifted to a low level. As a result, circuit 50 ceases to oscillate and the power applied to lamp 18 is terminated. Consequently, the feedback loop formed by circuit 12, power circuit 14 and lamp 18 is interrupted. NPN transistor 60 turns off thereby isolating the charge on capacitor 28. Capacitor 28 holds or stores the charge at the CRECT pin constant, except for leakage current, until control signal 21 shifts back to a high level. When control signal 21 shifts back to the first state in order to return system 10 to steady state operation, the instantaneous lamp power just prior to the interruption is still available at CRECT pin of integrated circuit 50. Thus, the feedback loop returns to steady state operation using substantially the same instantaneous lamp power that was present just prior to the interruption. As a result, transient oscillations, overshoots and pulses are substantially eliminated as feedback loop operation resumes.

Thus, system 10 of the present invention:

a) provides an efficient and inexpensive technique for interrupting the operation of a feedback loop;

b) exhibits consistent and accurate performance that is not affected by component values and operating conditions; and c) can be implemented with commercially available components.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

Thus, having described the invention, what is claimed is:

1. A system for substantially eliminating transients upon the resumption of feedback loop steady state operation after feedback loop interruption, the system comprising:

a first circuit for applying a state variable to a load;

a second circuit for (i) controlling the first circuit, (ii) monitoring the state variable applied to the load, and (iii) controlling the first circuit to regulate the state variable applied to the load in accordance with a desired state variable, the first and second circuits and the load defining a feedback loop, the second circuit further including an input for receiving a control signal that has a first state that causes the second circuit to enable the first circuit to apply the state variable to the load, and a second state that causes the second circuit to inhibit the first circuit from applying the state variable to the load thereby interrupting the feedback loop; and a third circuit for storing the applied state variable and preventing decay of the stored state variable during interruption of the feedback loop, the feedback loop resuming operation and returning to a steady state operation in accordance with the stored state variable when the control signal returns to the first state thereby substantially preventing the occurrence of transients from being introduced into the system.

2. A system for substantially eliminating transients upon the resumption of feedback loop steady state operation after feedback loop interruption, the system comprising:

a first circuit for applying power to a load;

a second circuit for (i) controlling the first circuit, (ii) monitoring the power applied to the load, and (iii) controlling the first circuit to regulate the power to the load in accordance with a predetermined amount of power, the first and second circuits and the load defining a feedback loop, the second circuit further including an input for receiving a control signal that has a first state that causes the second circuit to enable the first circuit to apply the power to the load, and a second state that causes the second circuit to inhibit the first circuit from applying the power to the load thereby interrupting the feedbacks loop; and a third circuit for storing a signal representative of the power applied to the load and preventing decay of the stored signal during feedback loop interruption, the feedback loop resuming operation and returning to a steady state operation in accordance with the stored signal when the control signal returns to the first state thereby substantially preventing the occurrence of transients from being introduced into the system.

3. The circuit according to claim 2 wherein the third circuit comprises a control device and a signal storage device that stores the signal representative of the power applied to the load, the control device being responsive to the control signal such that when the control signal has the second state and the feedback loop is interrupted, the control device prevents decay of the stored signal in the power storage device.

4. The circuit according to claim 3 wherein the signal storage device comprises a capacitor, a resistor and a switch, the switch having a first state that configures the capacitor and resistor into a parallel circuit and a second state that isolates the capacitor from the resistor to prevent decay of the signal stored in the capacitor, the switch being configured in the first state when the control signal has the first state and configured in the second state when the control signal has the second state.

5. The circuit according to claim 4 wherein the switch is a transistor.

6. A ballast for powering a load having a lamp, comprising:

a power circuit for applying power to a lamp;

a control circuit for (i) controlling the power circuit, (ii) monitoring the power applied to the lamp, and (iii) controlling the power circuit to regulate the power to the lamp in accordance with a predetermined amount of power, the control and power circuits and the lamp defining a feedback loop, the control circuit further including an input for receiving a control signal that has a first state that causes the control circuit to enable the power circuit to apply the power to the lamp, and a second state that causes the control circuit to inhibit the power circuit from applying the power to the lamp thereby interrupting the feedback loop;

a dimming circuit for dimming the lamp, the dimming circuit comprising circuitry for generating the control signal wherein the first state of the control signal effects illumination of the lamp and the second state interrupts the feedback loop and prevents illumination of the lamp; and a storage circuit for storing a signal representative of the power applied to the load and preventing decay of the stored signal during feedback loop interruption so as to enable the feedback loop to resume operation and return to a steady state operation in accordance with the stored signal when the control signal returns to the first state, the storage circuit comprising a control device and a storage device, the control device being responsive to the control signal such that when the control signal has the second state and the feedback loop is interrupted, the control device prevents decay of the signal stored in the storage device.

7. The fluorescent lamp system according to claim 3 wherein the control device comprises a switch and the storage device comprises a capacitor and a resistor, the switch being responsive to the control signal wherein the switch configures the capacitor and resistor into a parallel circuit when the control signal has the first state, and isolates the capacitor, from the resistor to prevent decay of the signal stored in the capacitor when the control signal has the second state.

8. A method of operating a ballast for powering a lamp, comprising the steps of:

applying power to the lamp;

storing a signal representative of the power applied to the lamp;

monitoring the power applied to the lamp;

regulating the power applied to the lamp in accordance with a predetermined power, the applying, monitoring and regulating steps defining a feedback loop operation of the ballast;

interrupting the applying, monitoring and regulating steps so as to effect dimming of the lamp; and resuming the applying, monitoring and regulating steps so as to return to the feedback loop operation to steady state operation in accordance with the stored signal.

9. The method according to claim 8 further comprising the storing step comprises the step of providing a storage circuit for storing the signal representative of the power applied to the lamp and preventing decay of the stored signal during interruption of the feedback loop operation.

10. The method according to claim 9 wherein the storage circuit comprises a switch and a combination of a capacitor and a resistor, the switch having a first configuration wherein the switch arranges the capacitor and resistor into a parallel circuit and a second configuration that isolates the capacitor from the resistor to prevent decay of the signal stored in the capacitor, and wherein:

the interrupting step further comprises the step of controlling the switch to have the second configuration; and the resuming step further comprises the step of controlling the switch to have the first configuration.

* * * * *